US010676327B2

(12) United States Patent
Staudecker et al.

(10) Patent No.: US 10,676,327 B2
(45) Date of Patent: Jun. 9, 2020

(54) METHOD FOR DAMPING ROTATIONAL OSCILLATIONS OF A LOAD-HANDLING ELEMENT OF A LIFTING DEVICE

(71) Applicant: B&R INDUSTRIAL AUTOMATION GMBH, Eggelsberg (AT)

(72) Inventors: Martin Staudecker, Linz (AT); Thomas J. Frauscher, Eggelsberg (AT); Ralf Skotschek, Steyr (AT)

(73) Assignee: B&R INDUSTRIAL AUTOMATION GMBH, Eggelsberg (AT)

( * ) Notice: Subject to any disclaimer, the term of this patent is extended or adjusted under 35 U.S.C. 154(b) by 14 days.

(21) Appl. No.: 15/990,052

(22) Filed: May 25, 2018

(65) Prior Publication Data

US 2018/0339888 A1 Nov. 29, 2018

(30) Foreign Application Priority Data

May 29, 2017 (AT) ..... A 50448/2017

(51) Int. Cl.
*B66C 13/04* (2006.01)
*B66C 13/06* (2006.01)

(52) U.S. Cl.
CPC ..... *B66C 13/04* (2013.01); *B66C 13/063* (2013.01)

(58) Field of Classification Search
CPC ..... B66C 13/00; B66C 13/04; B66C 13/06; B66C 13/063; B66C 13/08; B66C 13/085
See application file for complete search history.

(56) References Cited

U.S. PATENT DOCUMENTS 3,899,083 A * 8/1975 Flessner ..... B66C 13/06 212/274
4,531,647 A * 7/1985 Higuchi ..... B66C 13/06 212/274
4,784,420 A * 11/1988 Makino ..... B66C 13/06 212/274
5,819,962 A * 10/1998 Okubo ..... B66C 13/06 212/275
2004/0069734 A1* 4/2004 Hakala ..... B66C 13/06 212/274

(Continued)

FOREIGN PATENT DOCUMENTS

DE 10 2010 054 502 6/2012
EP 2878566 6/2015

OTHER PUBLICATIONS

Machine Translation for EP 2,878,566 (Year: 2015).*

(Continued)

*Primary Examiner* — Michael R Mansen
*Assistant Examiner* — Juan J Campos, Jr.
(74) *Attorney, Agent, or Firm* — Greenblum & Bernstein, P.L.C.

(57) ABSTRACT

A method for damping rotational oscillations of a load-handling element of a lifting device is created, wherein at least one controller parameter is determined by a rotational oscillation model of the load-handling element as a function of the lifting height ($l_H$) and wherein, to damp the rotational oscillation of the load-handling element at any lifting height ($l_H$), the at least one controller parameter is adapted to the lifting height ($l_H$).

20 Claims, 3 Drawing Sheets

(56) References Cited

U.S. PATENT DOCUMENTS

2007/0289931 A1 12/2007 Henriksson

OTHER PUBLICATIONS

Figure 1:
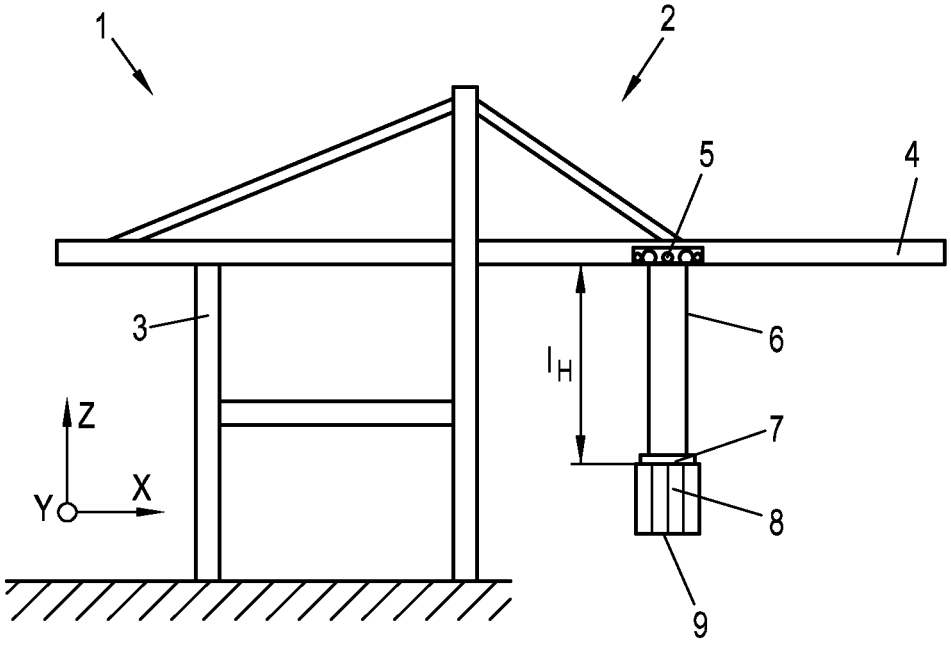

Ngo et al., "Skew Control of quay container crane", Journal of Mechanical Science and Technology, pp. 23, (2009).
Austria Search Report conducted in counterpart Austria Appln. No. A50448/2017 (dated Mar. 14, 2018).

* cited by examiner

METHOD FOR DAMPING ROTATIONAL OSCILLATIONS OF A LOAD-HANDLING ELEMENT OF A LIFTING DEVICE

This application claims priority under 35 U.S.C. § 119(a) of Austria Application No. A50448/2017 filed May 29, 2017, the disclosure of which is expressly incorporated by reference herein in its entirety.

The present invention relates to a method for damping rotational oscillation about a vertical axis of a load-handling element of a lifting device by means of a damping controller having at least one controller parameter, wherein the load-handling element is connected to a suspension element of the lifting device by means of at least three holding elements and the length of at least one holding element between the load-handling element and the suspension element is adjusted by the damping controller by means of an actuator, which acts on the at least one holding element.

Lifting devices, more particularly cranes, exist in many different embodiments and are used in many different areas of application. For example, there are tower cranes, which are used predominantly for construction above and below ground level, and there are mobile cranes, e.g. for assembling wind turbines. Bridge cranes are used, for example, as indoor cranes in factory buildings and gantry cranes are used, for example, to manipulate shipping containers at transshipment facilities for the intermodal transshipment of goods, for example in ports for transshipment from ships to rail or truck or at freight stations for transshipment from rail to truck or vice versa. The goods are predominantly stored for transport in standardized containers "ISO containers" which are equally suitable for transport in the three transport modes of road, rail, and water. The structure and mode of operation of a gantry crane is well known and is described, for example, in US 2007/0289931 A1 by means of a "ship-to-shore crane." The crane has a supporting structure or a gantry, on which a boom is arranged. By means of wheels, the gantry is movably arranged on a track, for example, and can be moved in one direction. The boom is fixedly connected to the gantry, and in turn a trolley is arranged on the boom. The trolley can be moved along the boom. In order to pick up freight, such as an ISO container, the trolley is connected to a load-handling element, a "spreader," by means of four cables. The spreader can be raised or lowered by means of cable winches, here by means of two cable winches for two cables each, in order to pick up and manipulate a container. The spreader can also be adapted to containers of different sizes.

To increase the economy of logistics processes, very fast transshipment of goods, among other things, is required, i.e., for example, very fast processes for loading and unloading cargo ships and correspondingly fast processes for moving the load-handling elements and the gantry cranes as a whole. However, such fast movement processes can cause undesired oscillations of the load-handling element, which in turn delay the manipulation process, because the containers cannot be placed precisely in the intended location. In particular rotational oscillations of the load-handling element, i.e. oscillations about the vertical axis, are disturbing, because such oscillations are difficult to compensate by the crane operator with conventional cranes. Such rotational oscillations can also be caused or intensified by, for example, an uneven load in the container or wind influences.

US 2007/0289931 A1 mentions the problem of oscillations about the vertical axis (skew), among other things, but does not propose a satisfactory solution. To measure the deviations of the load-handling element from a desired position and to measure the distance of the load-handling element from the trolley, a target object consisting of light elements is provided on the load-handling element and a corresponding CCD camera is provided on the trolley. Thus, angular deviations about the vertical axis (skew), the longitudinal axis (list), and the transverse axis (trim) can be determined. To compensate the deviations, an actuator is provided for each holding cable, by means of which actuator the length of the holding cable can be changed. The actuators are controlled in different ways, depending on the deviation (trim, list, or skew), so that the individual holding cables are shortened or lengthened and the corresponding error is compensated. A disadvantage in this case is that the method merely proposes compensation of angular errors without taking into account the dynamics of rotational oscillation. Rotational oscillations cannot be compensated by means of said method.

DE 102010054502 A1 proposes arranging a slewing unit between the load-handling element and the holding cables to compensate rotational oscillations of the load-handling element. However, this is very elaborate and thus expensive, and the payload capacity is reduced by the weight of the slewing unit.

In the publication Quang Hieu Ngo et al., 2009, Skew Control of a quay container crane, in: Journal of Mechanical Science and Technology 23,2009, a control method for compensating rotational oscillations of the load-handling element of a gantry crane is proposed. In this case, similarly to US 2007/0289931 A1, an actuator for changing the cable length is arranged on each holding cable and a lighting element is arranged on the load-handling element, which lighting element interacts with a CCD camera arranged on the trolley for measurement of the angular deviation of the load-handling element. A mathematical model and an "input-shaping" control method are used to damp the rotational oscillation of the load-handling element. The input-shaping method is a type of feed-forward control that allows the angle of rotation of the load-handling element to be adjusted. It does not enable damping of an existing rotational oscillation. There is also the disadvantage that the mathematical model used in the input-shaping method must be very accurate, because there is no possibility of compensating parameter deviations.

Therefore, the problem addressed by the invention is that of eliminating the disadvantages of the prior art. In particular, a method for damping rotational oscillations of a load-handling element of a lifting device should be created.

The problem is solved according to the invention in that the at least one controller parameter is determined by means of a rotational oscillation model of the load-handling element as a function of the lifting height and that, to damp the rotational oscillation of the load-handling element at any lifting height, the at least one controller parameter is adapted to said lifting height. This simple method makes it possible to damp rotational oscillation of a load-handling element at any lifting height without the one or more controller parameters of the damping controller having to be manually determined. Consequently, the operation of the lifting device or fast movement and accurate positioning of a load are considerably simplified, leading to time savings and thus to an increase in productivity.

The load-handling element is preferably excited to rotationally oscillate at a certain lifting height of the load-handling element, wherein at least an actual angle of rotation of the load-handling element about the vertical axis and an actual actuator position are sensed and, by means thereof, model parameters of the rotational oscillation model of the load-handling element at the given lifting height are identified by an identification method. Unknown model parameters of a selected rotational oscillation model can thus be determined by means of a suitable identification method, whereby unknown oscillation behavior of the load-handling element can be determined and can be used to damp the rotational oscillation.

Advantageously, the at least one actuator is hydraulically or electrically actuated, so that standard components such as hydraulic cylinders or electric motors and an available energy supply system can be used.

If at least four holding elements are provided between the load-handling element and the suspension element, larger loads can be manipulated.

It is advantageous if at least two actuators are provided, more particularly one actuator per holding element. Consequently, redundancy of the rotational oscillation damping can be realized, whereby the reliability can be increased, and smaller actuators of lower inertia can be used, whereby the response time of the damping control can be shortened and the control performance can be improved.

The lifting height is advantageously measured by means of a camera system arranged on the suspension element or on the load-handling element or by means of a lifting drive of the lifting device. Consequently, the lifting height can be sensed very accurately and simply.

The angle of rotation of the load-handling element is preferably measured by means of a camera system arranged on the suspension element or on the load-handling element. With this simple technique, the angle of rotation of the load-handling element can be determined very accurately. A camera system is also relatively simple to retrofit on an existing lifting device.

According to a preferred embodiment, the rotational oscillation model is a second-order differential equation having at least three model parameters, more particularly a dynamic parameter $\delta$, a damping parameter $\xi$, and a system gain parameter $i_\beta$. With the mathematical modeling of the rotational oscillation system by means of a second-order differential equation, a simple yet sufficiently accurate representation of the real rotational oscillation is created.

It is advantageous if the identification method is a mathematical method, more particularly an online least-squares method. With this common mathematical method, model parameters can be determined simply and with sufficient accuracy.

It is advantageous if a state controller having preferably five controller parameters $K_I$, $K_1$, $K_2$, $K_{FF}$, $K_P$ is used as the damping controller. Consequently, a fast and stable damping controller having good control performance is created. By means of integrated feed-forward control (controller parameter $K_{FF}$), the guidance behavior can be improved, and, by means of an integrator (controller parameter $K_I$), steady accuracy is achieved or model uncertainties can be compensated.

According to a preferred embodiment, a desired angle of rotation of the load-handling element is specified to the damping controller and the damping controller attains said desired angle of rotation in a specified angle range, more particularly in an angle range of $-10° \leq \beta_{soll} \leq +10°$. Consequently, desired rotation of the load-handling element can be achieved, whereby loads such as containers can be positioned even on targets that are not exactly aligned, such as trucks sitting aslant.

Anti-windup protection is advantageously integrated in the damping controller, wherein actuator limitations of the at least one actuator, more particularly a maximum/minimum permissible actuator position $s_{zul}$, a maximum/minimum permissible actuator velocity $v_{zul}$, and a maximum/minimum permissible actuator acceleration $a_{zul}$ of the actuator, are specified to the damping controller. By means of this "anti-windup protection," impermissibly high manipulated variables of the at least one actuator, which could lead to destabilization of the damping controller, can be avoided.

Figure 2A:
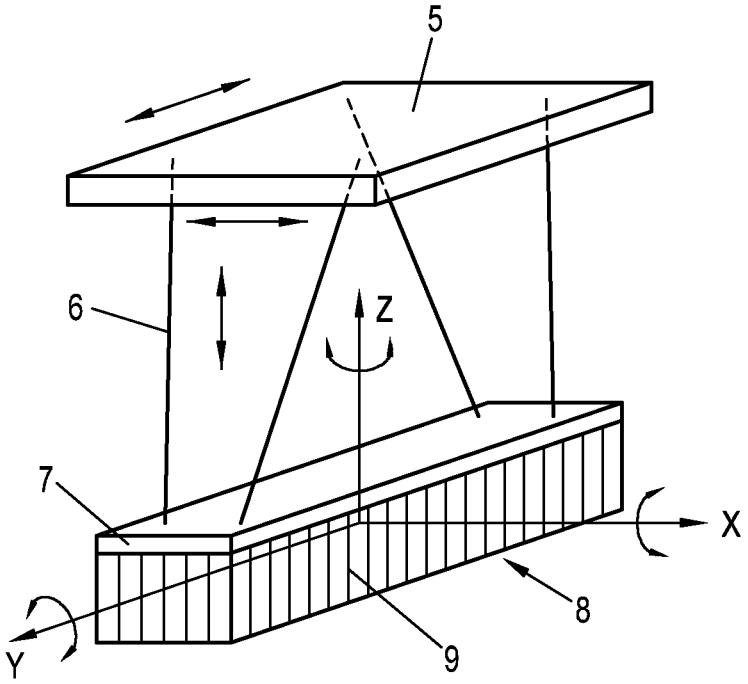
Figure 2B:
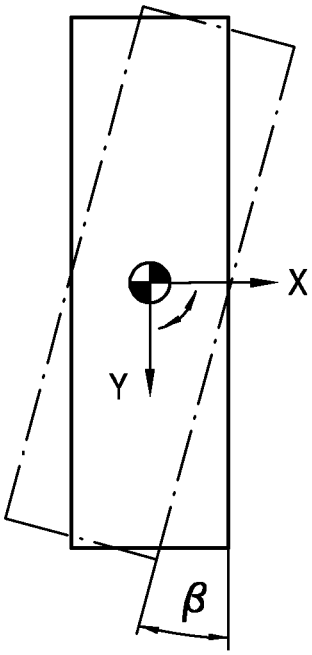
Figure 3:
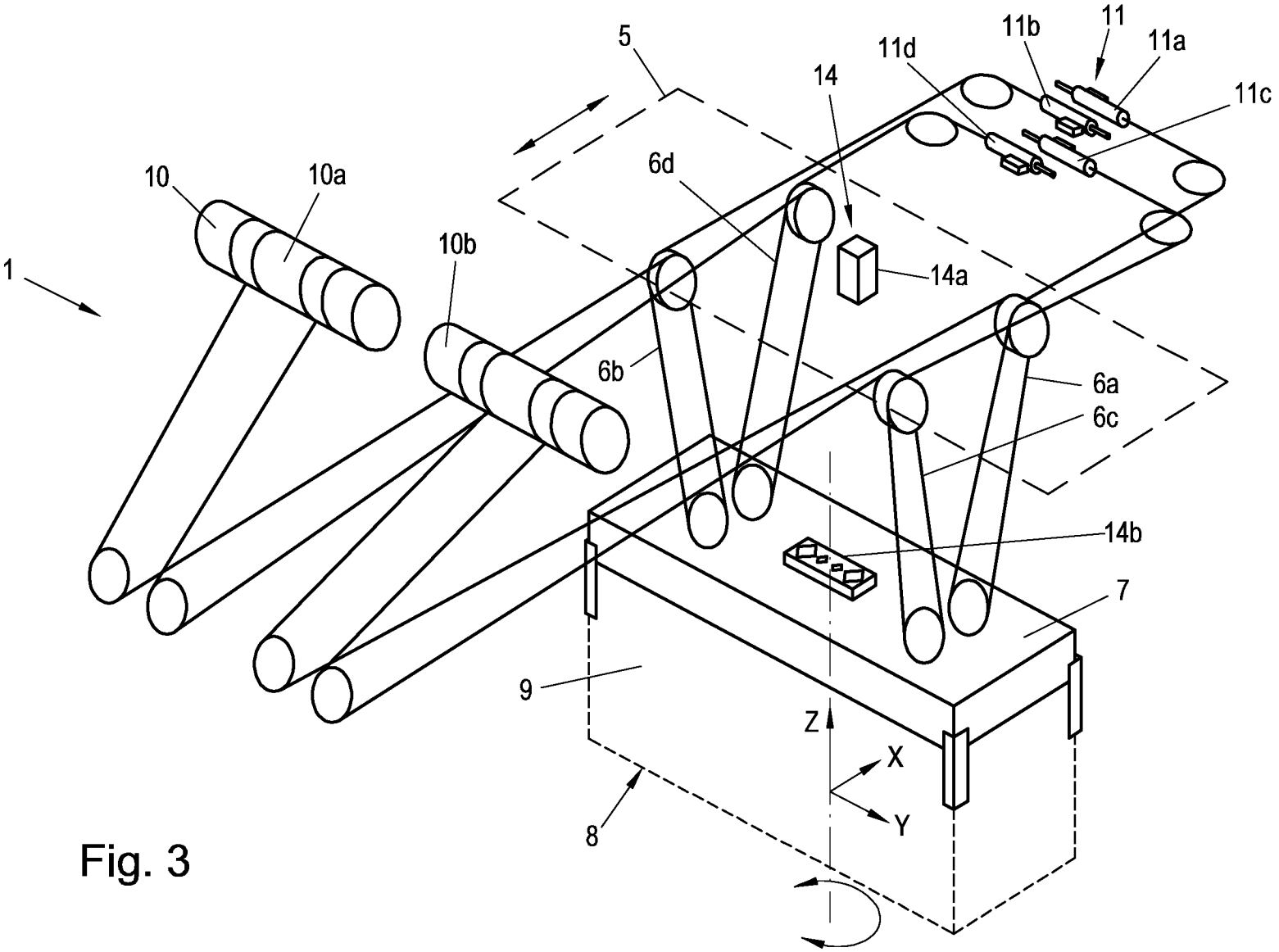
Figure 4:
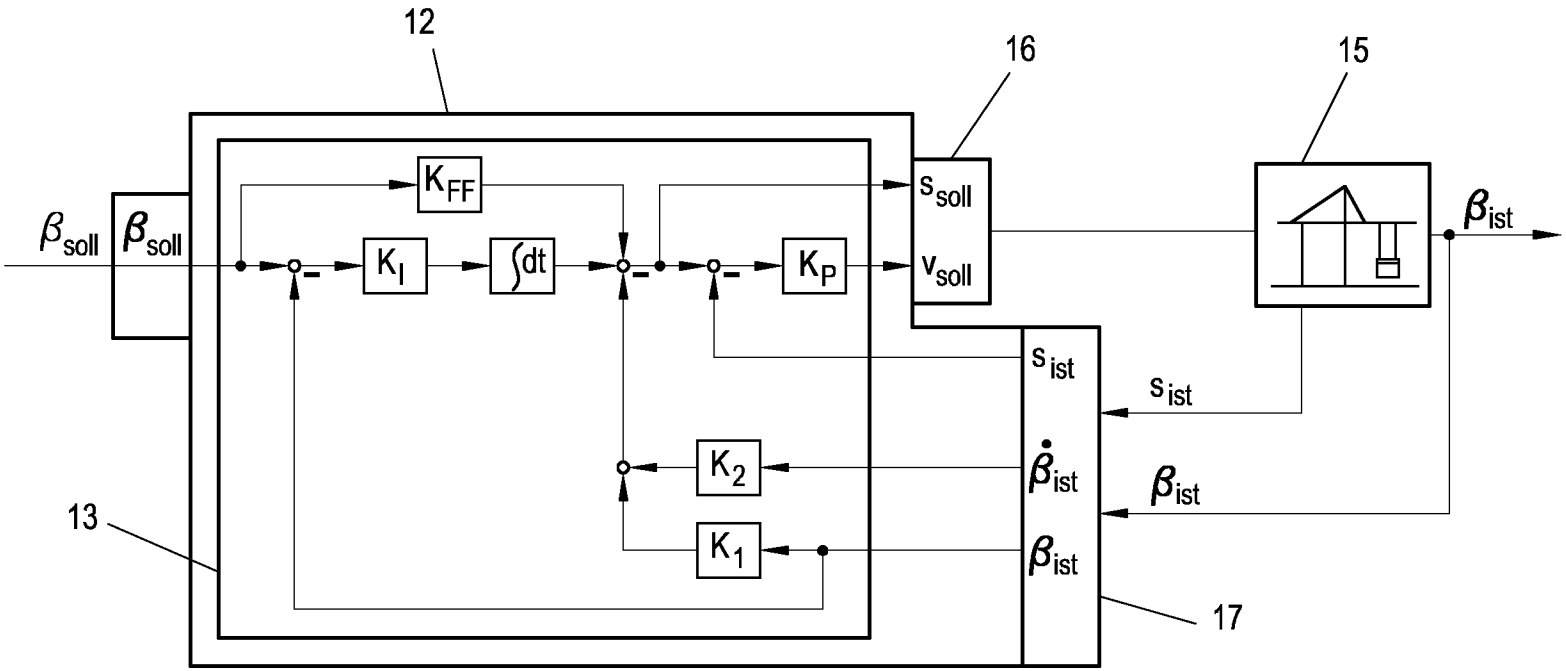
Figure 5:
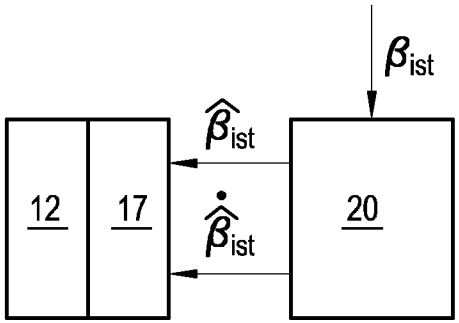

The present invention is explained in greater detail below with reference to FIGS. 1 to 4, which show advantageous embodiments of the invention as schematically illustrated examples without imposing restrictions. The figures show:

FIG. 1: the basic structure of a lifting device by means of a container crane, FIGS. 2*a* and 2*b*: a load-handling element including load for showing rotational oscillation, FIG. 3: a part of a schematically illustrated lifting device, FIG. 4: a controller structure of a damping controller, FIG. 5: a state estimation unit.

FIG. 1 shows an example of a lifting device 1 by means of a schematically illustrated container crane 2, which is used, for example, to load and unload ships in a port. A container crane 2 usually has a supporting structure 3, which is fixedly or movably arranged on the ground. In the case of movable arrangement, the supporting structure 3 can be arranged on rails for movement in the Y direction, for example, as schematically shown in FIG. 1. Because of this degree of freedom in the Y direction, the container crane 2 can be used flexibly with respect to location. The supporting structure 3 has a boom 4, which is fixedly connected to the supporting structure 3. A suspension element 5 is usually arranged on said boom 4, which suspension element 5 can be moved in the longitudinal direction of the boom 4, i.e. in the X direction in the example shown. For example, a suspension element 5 can be mounted in guides by means of rollers. The suspension element 5 is usually connected by means of holding elements 6 to a load-handling element 7 for picking up a load 8. In the case of a container crane 2, the load 8 is usually a container 9, in most cases an ISO container having a length of 20, 40, or 45 feet and a width of 8 feet. However, there are also load-handling elements 7 that are suitable for simultaneously picking up two containers 9 next to each other ("dual spreaders"). For the damping method according to the invention, the type and design of the load-handling element 7 is not further relevant, however; any embodiments of the load-handling element 7 can be used. The holding elements 6 are usually designed as cables, wherein in most cases four holding elements 6 are arranged on the suspension element 5, but more or fewer holding elements 6 can also be provided, but at least three holding elements 6. In order to pick up a load 8, such as a container 9, the lifting height $l_H$ between the suspension element 5 and the load-handling element 7 can be adjusted by means of a lifting drive 10 (see FIG. 3), for example in the Z direction as shown in FIG. 1. If the holding elements 6 are designed as cables, the lifting height $l_H$ is usually adjusted by means of one or more cable winches 10*a*, 10*b*, as shown schematically in FIG. 3. To manipulate loads 8 or containers 9, the lifting device 1 or the container crane 2 can thus be moved in the direction of three axes. Because of fast movement sequences, uneven load in the container 9, or wind influences, the load-handling element 7 arranged on the holding elements 6, with the container 9 arranged on the load-handling element 7, can be excited to oscillate, as presented below by means of FIGS. 2*a* and 2*b*.

FIG. 2*a* schematically shows a suspension element 5, on which a load-handling element 7 including a load 8 is arranged by means of four holding elements 6. The coordinate system shows the degrees of freedom of the load-handling element 7. The straight double arrows symbolize the possible directions of movement of the load-handling element 7, wherein the movement in the Y direction occurs by movement of the entire lifting device 1 in the presented example, the movement in the X direction occurs by movement of the suspension element 5 on the boom 4 (lifting device 1 and boom 4 not shown in FIG. 1*a*), and the movement in the Z direction occurs by the changing of the lifting height $l_H$ by means of the holding elements 6 and a lifting drive 10 (not shown). The curved double arrows symbolize the possible rotations of the load-handling element 7 about the respective axes. Rotation about the X axis or the Y axis can be compensated by the user of the lifting device 1 or of the container crane 2 relatively easily and are not described in greater detail here. Rotation about the Z axis (i.e. about the vertical axis), as shown in FIG. 2*b*, is very disturbing, as mentioned above, because in particular rotational oscillation of the load-handling element 7 about the Z axis would impede or delay the positioning of a load 8 in a certain location, for example on the cargo bed of a track or of a rail car.

According to the invention, a method is therefore provided by means of which such rotational oscillation of a load-handling element 7 about the vertical axis can be simply and quickly damped so that fast movement processes of the load-handling element 7 with the load 8 arranged thereon are enabled, which should contribute to an increase in the efficiency of goods manipulation. A detailed description of the method is provided below by means of FIGS. 3 and 4.

Of course, the described embodiment of the lifting device 1 as a container crane 2 according to FIGS. 1 to 3 should be understood merely as an example. The lifting device 1 can also be designed in any other way for the application of the method according to the invention, for example as an indoor crane, rotating tower crane, or mobile crane. All that is important is the basic function of the lifting device 1 and that the lifting device 1 has the essential components for carrying out the damping method according to the invention, as described below.

The essential components of a lifting device 1 are shown in FIG. 3, in this case by means of the components of a container crane 2. The parts essential to the invention are shown. The structure and mode of operation of such cranes have already been described, are well known, and therefore do not have to be explained in greater detail. According to a preferred embodiment of the invention, four holding elements 6*a*, 6*b*, 6*c*, 6*d*, which can be designed, for example, as high-strength cables, more particularly as steel cables, are arranged between the suspension element 5 (shown schematically with dashed lines in FIG. 3) and the load-handling element 7. A lifting drive 10 is provided for raising and lowering the load-handling element 7 in the Z direction, i.e. for adjusting the lifting height $l_H$. In the example according to FIG. 3, the lifting drive 10 is formed by cable winches 10*a* and 10*b*, wherein two holding elements 6*a*, 6*c* and 6*b*, 6*d*, respectively, are wound on each cable winch 10*a*, 10*b*. Of course, other forms of the lifting drive are also conceivable. To carry out the method according to the invention, at least one actuator 11*a*, 11 *b*, 11*c*, 11 *d* is provided on at least one holding element 6*a*, 6*b*, 6*c*, 6*d* for changing the length of the holding element 6. However, it is advantageous if an actuator 11*a*, 11 *b*, 11*c*, 11*d* is provided on each holding element 6*a*, 6*b*, 6*c*, 6*d*. Four holding elements 6*a*, 6*b*, 6*c*, 6*d* each having one actuator 11*a*, 11 *b*, 11*c*, 11 *d* are preferably arranged on the lifting device 1, as can be seen in FIG. 3.

In the case of a lifting drive 10 as shown in FIG. 3, the holding elements 6*a*, 6*b*, 6*c*, 6*d* are guided by means of deflecting rollers, which are arranged on the load-handling element 7. The free end of each of the holding elements 6*a*, 6*b*, 6*c*, 6*d* is fastened to a stationary holding point, for example on the suspension element 5. In this embodiment, an actuator 11*a*, 11*b*, 11*c*, 11*d* is preferably fastened to a stationary holding point, for example on the suspension element 5, and the free end of the holding elements 6*a*, 6*b*, 6*c*, 6*d* is fastened to the actuator 11*a*, 11*b*, 11*c*, 11*d*. Consequently, the length of a holding element 6*a*, 6*b*, 6*c*, 6*d* can be adjusted by adjustment of the actuator 11*a*, 11 *b*, 11*c*, 11*d*, whereby the distance between the suspension element 5 and the load-handling element 7 is also adjusted.

An actuator 11*a*, 11*b*, 11*c*, 11*d* can be controlled by a damping controller 12 to change the length of the corresponding holding element 6*a*, 6*b*, 6*c*, 6*d* between the suspension element 5 and the load-handling element 7, and, in the event of this, preferably at least one desired actuator position $s_{soll}$ or one desired actuator velocity $v_{soll}$ can be specified to the actuator 11*a*, 11*b*, 11*c*, 11*d*. For the damping control, at least an actual actuator position $s_{ist}$ of the at least one actuator 11*a*, 11*b*, 11*c*, 11 *d* can be captured by the damping controller 12 (damping controller 12 not shown in FIG. 3). For example, the damping controller 12 can be designed as a separate component in the form of hardware and/or software or can be implemented in an existing crane control system. As described in detail below, the at least one actuator 11*a*, 11*b*, 11*c*, 11 *d* can be controlled by the damping controller 12 in such a way that, by the changing of the actuator position and/or actuator velocity, the load-handling element 7 is excited to rotationally oscillate (as symbolized by the double arrow in FIG. 3), or the at least one actuator 11*a*, 11*b*, 11*c*, 11*d* can be controlled in such a way that rotational oscillation of the load-handling element 7 is damped.

In the presented embodiment, preferably the lengths of two diagonally opposite holding elements 6*a*, 6*b* between the suspension element 5 and the load-handling element 7 are increased by means of the corresponding actuators 11*a*, 11*b* and the lengths of the two other diagonally opposite holding elements 6*c*, 6*d* are decreased by means of the corresponding actuators 11*c*, 11*d*, or vice versa, to stimulate or damp rotational oscillation. However, it is also possible, for example, that only three holding elements 6 are arranged between the suspension element 5 and the load-handling element 7 and only one actuator 11 is arranged for changing the length of one of the three holding elements 6. It is only important that the length of at least one holding element 6*a*, 6*b*, 6*c*, 6*d* between the suspension element 5 and the load-handling element 7 can be changed by means of the at least one actuator 11*a*, 11*b*, 11*c*, 11 *d* so that rotational oscillation of the load-handling element 7 about the vertical axis, in FIG. 3 about the Z axis, can be stimulated or damped.

An actuator 11*a*, 11*b*, 11*c*, 11 *d* can be implemented in any manner; a hydraulic or electrical embodiment that allows length adjustment is preferably used. If, as shown in FIG. 3, actuators 11*a*, 11*b*, 11*c*, 11 *d* are used in the form of hydraulic cylinders, the energy for actuating the actuators 11*a*, 11*b*, 11*c*, 11 *d* can be drawn from an existing hydraulic system, for example. However, an actuator 11*a*, 11*b*, 11*c*, 11 *d* can also, for example, be implemented as a cable winch and be electrically controlled, wherein the actuating energy can be drawn from an existing power grid. Other embodiments of an actuator 11*a*, 11*b*, 11*c*, 11*d* that are suitable for changing the length of a holding element 6 between the suspension element 5 and the load-handling element 7 are also conceivable. In particular, an actuator 11*a*, 11 *b*, 11*c*, 11*d* must handle the expected forces during the raising and lowering of a load 8. To effect a required length change of a holding element 6*a*, 6*b*, 6*c*, 6*d* under certain loading, an actuator 11*a*, 11*b*, 11*c*, 11 *d* can also have an additional speed-changing gearset, for example.

To carry out the damping method according to the invention, it is provided that at least an actual angle of rotation $\beta_{ist}$ of the load-handling element 7 about the Z axis (or vertical axis) can be sensed; for example, a measuring device 14 in the form of a camera system can be provided, wherein a camera 14*a* is arranged on the suspension element 5 and a measurement element 14*b*, which interacts with the camera 14*a*, is arranged on the load-handling element 7, or vice versa. However, the actual angle of rotation $\beta_{ist}$ can also be measured in another way, for example by means of a gyro sensor. What is important is that a measurement signal for the actual angle of rotation $\beta_{ist}$ is available, which measurement signal can be fed to the damping controller 12. It is also provided that the lifting height $l_H$ between the suspension element 5 and the load-handling element 7 can be sensed. For example, the lifting height $l_H$ can be sensed by means of the lifting drive 10, for example in the form of a position signal of a cable winch 10*a*, 10*b*, said position signal being available in the crane control system. The lifting height $l_H$ could also be obtained from the crane control system. However, the lifting height $l_H$ can also be sensed, for example, by means of the measuring device 14, for example by means of a camera system that can sense both the lifting height $l_H$ and the actual angle of rotation $\beta_{ist}$. Such measuring devices 14 are known in the prior art and therefore are not discussed in greater detail here.

The individual steps of the damping method are described below by means of FIG. 4.

FIG. 4 shows a block diagram of a possible embodiment of the control structure according to the invention, with a damping controller 12, which, as already explained, can be implemented either as a separate component or preferably in the control system of the lifting device 1, and with a controlled system 15, which is controlled by the damping controller 12. In the embodiment example shown, the damping controller 12 is implemented as a state controller 13. However, in principle any other suitable controller can be used. The controlled system 15 is the system described by means of FIG. 3. The setpoint of the damping controller 12 is a desired angle of rotation $\beta_{soll}$ of the load-handling element 7 and the manipulated variable is preferably a desired actuator position $s_{soll}$ of the at least one actuator 11*a*, 11*b*, 11*c*, 11*d*. Alternatively, a desired actuator velocity $v_{soll}$ can be used as the manipulated variable instead of the desired actuator position $s_{soll}$. As already described, the actual angle of rotation $\beta_{ist}$ can be sensed by means of a measuring device 14, for example by means of a camera system. As feedback, at least the sensed actual angle of rotation $\beta_{ist}$ of the load-handling element 7 is fed to the damping controller 12 (and, in the case of the use of the desired actuator velocity $v_{soll}$ as the manipulated variable, also the sensed actual actuator position $s_{ist}$). It would also be conceivable to additionally sense an actual angular velocity $\dot{\beta}_{ist}$ and to feed the same to the damping controller 12, whereby the damping control could be improved further. Of course, an actual angular velocity $\dot{\beta}_{ist}$ or an actual angular acceleration $\ddot{\beta}_{ist}$ can also be derived from the sensed actual angle of rotation $\beta_{ist}$ if necessary, for example by derivation with respect to time.

The required actual values, in particular the actual angle of rotation $\beta_{ist}$ and possibly derivatives thereof with respect to time, either can be directly measured or can, at least in part, also be estimated in an observer. An advantage of the use of actual values, such as an actual angle of rotation $\beta_{ist}$, estimated by means of an observer is that any measurement noise of measurement values of a measuring device 14, which measurement noise is undesired for the damping control, can thereby be avoided. This is the main reason why, in a preferred embodiment according to FIG. 3, the actual angle of rotation $\beta_{ist}$ is measured by means of a measuring device 14 but nevertheless an estimated actual angle of rotation $\hat{\beta}_{ist}$ is used for the damping control (an estimated actual angular velocity $\hat{\dot{\beta}}_{ist}$ could additionally be used; see FIG. 5). Any suitable and well known observers, such as a Kalman filter, that determine estimated values of the required actual values can be used in this case. Below, estimated values are marked with ^ where applicable.

However, it should be noted that the controller structure is secondary for the damping method according to the invention and in principle any suitable controller could be used. The required actual values are then fed to the damping controller 12 as measured values or estimated values, depending on the implementation.

The damping controller 12 has at least one controller parameter, preferably five controller parameters. By means of the one or more controller parameters, the characteristics of the control can be set, for example response behavior, dynamics, overshoot, damping, etc., wherein one of the properties can be adjusted by means of each controller parameter. If several properties should be influenced, a corresponding number of controller parameters is required. The system behavior of the controlled system can thus be adapted.

To design a suitable damping controller 12, the controlled system, i.e. the technical system to be controlled (e.g. as shown in FIG. 3), must first be modeled. In the present case, the rotational oscillation behavior of the load-handling element 7 about the Z axis is modeled by means of a rotational oscillation model, for example by means of a second-order differential equation in the form $\delta\ddot{\beta}+\xi\dot{\beta}+\beta=i_\beta s$. The three model parameters of said rotational oscillation model are a dynamic parameter $\delta$, a damping parameter $\xi$, and a system gain parameter $i_\beta$, which are defined, for example, as $$\delta = \frac{J_\beta}{c_\beta(l_H)}$$

with the mass moment of inertia $J_\beta$ of the load 8 together with the load-handling element 7 and $$\xi = \frac{d_\beta}{c_\beta(l_H)}$$

with a spring constant $c_\beta$ and a damping constant $d_\beta$ of the oscillation system. The spring constant $c_\beta$ is modeled in dependence on the lifting height $l_H$.

Said rotational oscillation model should be understood merely as an example. Other rotational oscillation models that are able to model or approximate the real rotational oscillation could also be used.

The model parameters of the rotational oscillation model, for example $\delta$, $\xi$, and $i_\beta$, can be known but are generally unknown. Therefore, the model parameters can be identified by means of an identification method in a first step. Such identification methods are well known, for example from Isermann, R.: Identifikation dynamischer Systeme, 2nd edition, Springer-Verlag, 1992 or Ljung, L.: System Identification: Theory for the User, 2nd edition, Prentice Hall, 2009, and therefore are not discussed in greater detail here. Common to the identification methods is that the system to be identified is excited with an input function (e.g. a step function) and the output variable is sensed and is compared with an output variable of the model. The model parameters are then varied to minimize the error between the measured output variable and the output variable calculated by means of the model. For possibly necessary identification, the damping controller 12 can be used to excite the load-handling element 7 with the load 8 arranged thereon to rotationally oscillate about the Z axis at a certain lifting height $l_H$. For this purpose, a separate excitation controller, for example in the form of a bang-bang controller, can be implemented in the damping controller 12. By means of the bang-bang controller, the at least one actuator 11*a*, 11*b*, 11*c*, 11*d* is controlled, for example, with the maximum possible desired actuator velocity $v_{soll}$ in accordance with the actual angle of rotation $\beta_{ist}$ of the load-handling element 7. This means that, for example, the at least one actuator 11*a*, 11*b*, 11*c*, 11*d* is controlled with the maximum possible negative actuator velocity v at an angle of rotation $\beta_{ist} \geq 0°$ of the load-handling element 7 and the at least one actuator 11*a*, 11*b*, 11*c*, 11*d* is controlled with the maximum possible positive actuator velocity v at an angle of rotation $\beta_{ist} \leq 0°$ of the load-handling element 7. In the case of an embodiment of the lifting device 1 according to FIG. 3 with four holding elements 6*a*, 6*b*, 6*c*, 6*d* and four actuators 11*a*, 11*b*, 11*c*, 11*d* interacting therewith, the excitation advantageously occurs oppositely, in that, for example, the actuators 11*a*, 11 *b* are controlled with the maximum possible positive actuator velocity v and the actuators 11*c*, 11*d* are controlled with the maximum possible negative actuator velocity v, or vice versa. The excitation to rotational oscillation can occur at any fixed lifting height $l_H$ of the load-handling element 7. From the stimulated rotational oscillation of the load-handling element 7, the damping controller 12 determines the model parameters of the implemented rotational oscillation model at the specified lifting height $l_H$ on the basis of the sensed actual angle of rotation $\beta_{ist}$ of the load-handling element 7 and the sensed actual actuator position $s_{ist}$ of the at least one actuator 11*a*, 11*b*, 11*c*, 11*d* by means of an identification method. In the case of the rotational oscillation model above, the dynamic parameter $\delta$ and the damping parameter $\xi$ are preferably first determined, and thereafter the system gain parameter $i_\beta$ is determined preferably at a standstill of the at least one actuator 11*a*, 11*b*, 11*c*, 11 *d* (actual actuator velocity $v_{ist}=0$). According to one embodiment of the invention, a mathematical online least-squares method is used as an identification method to identify the model parameters, but the use of other methods, such as offline least-square methods or optimization-based methods, would also be conceivable.

With the known (previously known or identified) model parameters, a damping controller 12 can then be designed for the rotational oscillation model. For this purpose, a suitable controller structure is selected, such as a PID controller or a state controller. Of course, every controller structure has a number of controller parameters $K_k$, $k \geq 1$, that must be set by means of a controller design method in such a way that desired control behavior results. Such controller design methods are likewise well known and are therefore not described in detail. The frequency response method, the root-locus method, controller design by pole placement, and the Riccati method are mentioned as examples, and there are of course many other methods. However, neither the specific controller structure nor the specific controller design method is important for the present invention. The desired control behavior too can be selected essentially as desired for the invention, of course while taking into consideration stability criteria and other boundary conditions. For the invention, it is only important that the controller parameters are defined in dependence on the lifting height $l_H$. This too can be accomplished in very different ways.

It would be conceivable to identify the model parameters for different lifting heights $l_H$ and to then determine the controller parameters $K_k$ for each of the different lifting heights $l_H$. In this way, characteristic curves of the controller parameters $K_k$ in dependence on the lifting height $l_H$ or characteristic maps in dependence on the lifting height $l_H$ and other variables, such as a mass moment of inertia $J_\beta$, can be constructed. This would of course be very complex and impractical. Therefore, the controller parameters $K_k$ of the damping controller 12 are preferably specified as a relationship expressed by a formula, as a function of at least the lifting height $l_H$ and optionally other model parameters, thus for example $K_k=f(l_H)$ or $K_k=f(l_H, \ldots)$. Thus, the controller parameters $K_k$ have to be defined only for one lifting height $l_H$ and can then be converted to other lifting heights $l_H$ in a simple manner. However, it is also possible to calculate the controller parameters $K_k$ for different lifting heights $l_H$ offline from the relationship expressed by a formula and to create a characteristic curve or a characteristic map therefrom, which is then used subsequently.

For the damping control, the controller parameters $K_k$ are adapted to the current lifting height $l_H$ in each time increment of the control, for example by read-out from a characteristic map or by calculation. The damping controller 12 then uses the adapted controller parameters $K_k$ to determine the manipulated variable, which is set by means of the at least one actuator 11*a*, 11*b*, 11*c*, 11*d* in the time increment in question. The controller parameters $K_k$ are adapted to the current lifting height $l_H$ in such a way that rotational oscillation of the load-handling element 7 can be optimally damped at any lifting height $l_H$.

In particular in the case of a lifting device 1 having a load-handling element 7, it is common to use different load-handling elements 7 or size-adjustable load-handling elements 7 for different loads 8, e.g. for containers of different size. Of course, this would directly affect the mass moment of inertia $J_\beta$. Therefore, it can be provided that the procedure above is carried out for different load-handling elements 7. Different controller parameters $K_k$ would thus be obtained for different load-handling elements 7.

The method according to the invention is explained below by means of a specific embodiment example. A rotational oscillation model in the form $\delta\ddot{\beta}+\xi\dot{\beta}+\beta=i_\beta s$, as described above, is used. The model parameters of the rotational oscillation model, e.g. $\delta$, $\xi$, and $i_\beta$, are identified for a certain lifting height $l_H$ as described. A state controller 13, as shown in FIG. 4, is used as the controller structure for the damping controller 12 because of the good control performance of said state controller. Five parameters $K_I$, $K_P$, $K_1$, $K_2$, $K_{FF}$ are provided as controller parameters $K_k$. For the design of the state controller 13, the system to be controlled is brought into a state space representation by means of the rotational oscillation model, as the controlled system 15, for example in the form $$\frac{d}{dt}\begin{bmatrix} s \\ \beta \\ \dot{\beta} \\ e_\beta \end{bmatrix} = \begin{bmatrix} 0 & 0 & 0 & 0 \\ 0 & 0 & 1 & 0 \\ \frac{i_\beta}{\delta} & -\frac{1}{\delta} & -\frac{\xi}{\delta} & 0 \\ 0 & -1 & 0 & 0 \end{bmatrix}\begin{bmatrix} s \\ \beta \\ \dot{\beta} \\ e_\beta \end{bmatrix} + \begin{bmatrix} 1 \\ 0 \\ 0 \\ 0 \end{bmatrix} v$$

The actuator position s, the angle of rotation $\beta$, the angular velocity $\dot{\beta}$, and a deviation $e_\beta$ between the desired angle of rotation $\beta_{soll}$ and the actual angle of rotation $\beta_{ist}$ are used as states of the system. The controller parameters $K_k$ were defined as follows as a function of the lifting height $l_H$, which is found in the model parameters $$\delta = \frac{J_\beta}{c_\beta(l_H)} \text{ and } \xi = \frac{d_\beta}{c_\beta(l_H)}.$$

$d_0$ is a damping constant of the closed control loop; i.e. the nearly undamped system is converted into a damped system by means of the damping controller 12. The parameters $\omega_i$ determine the dynamics and the response behavior of the control loop and are linked to the system properties of the rotational oscillation model to be identified (the index $i \geq 0$ stands for the number of parameters of the damping controller; in the presented example, these are the parameters $\omega_0$, $\omega_1$, $\omega_2$). The damping constant $d_0$ and the parameters $\omega_i$ are preferably pre-parameterized or predefined but can be adapted by the user if necessary.

$$K_p = 2d_0\omega_0 + \omega_1 + \omega_2$$

$$K_1 = \frac{1}{i_\beta K_p}((2d_0\omega_0\omega_1\omega_2 + (\omega_1 + \omega_2)\omega_0^2)\delta - K_p)$$

$$K_2 = \frac{1}{i_\beta K_p}((2d_0\omega_0(\omega_1 + \omega_2) + \omega_0^2 + \omega_1\omega_2)\delta - 1 - \xi K_p)$$

$$K_I = \frac{1}{i_\beta K_p}(\omega_0^2\omega_1\omega_2\delta)$$

$$K_{FF} = K_2 + \frac{1}{i_\beta}$$

In the damping controller 12, the controller parameters of the state controller 13 are then calculated by means of the current lifting height $l_H$ and used as the basis of the control in each time increment of the control. Thus, the rotational oscillation of the load-handling element 7 can be effectively damped during a lifting process, because the damping controller 12 automatically adapts to the current lifting height $l_H$.

As a manipulated variable of the control, the damping controller 12 can determine an actuator position $s_{soll}$ to be set or an actuator velocity $v_{soll}$ for the at least one actuator 11*a*, 11 *b*, 11*c*, 11*d* and output the same at an interface 16. For this purpose, the damping controller 12 receives the required actual values, such as the actual position $s_{ist}$ of the at least one actuator 11*a*, 11*b*, 11*c*, 11*d* and the actual angle of rotation $\beta_{ist}$ of the load-handling element 7, via an interface 17. The derivative of the actual angle of rotation $\beta_{ist}$ with respect to time can be determined in the damping controller 12 or is measured.

Alternatively, a state estimation unit 20 (FIG. 5), in the form of hardware and/or software, can be provided, which determines estimated values for the required input variables of the damping controller 12, here for example an estimated actual angle of rotation $\hat{\beta}_{ist}$ and an estimated actual angular velocity $\hat{\dot{\beta}}_{ist}$, from measured actual values, e.g. of the actual angle of rotation $\beta_{ist}$ of the load-handling element 7. The state estimation unit 20 can be implemented as a well known Kalman filter, for example. The rotational oscillation model can also be used in the state estimation unit 20 for this purpose.

A desired angle of rotation $\beta_{soll}$ of the load-handling element 7 is specified to the damping controller 12 and is attained by means of the damping controller 12. Normally a desired angle of rotation $\beta_{soll}=0$ is specified, and therefore rotational oscillations about a defined zero position are counteracted. However, a desired angle of rotation $\beta_{soll}$ deviating therefrom can also be specified, and therefore the load-handling element 7 is controlled to this angle by the damping controller 12 and independently of the lifting device 1 and also rotational oscillations about this angle are damped. For example, a load 8, such as a container 9, can thus be rotated in a specified angle range and thus also loaded onto a cargo bed of an inaccurately positioned truck, for example. An additional device for rotating the load-handling element 7 about the vertical axis is not required for this purpose. Depending on the type and design of the lifting device 1 and the components thereof, an angle of rotation $\beta$ of the load-handling element 7 can be set in a range of, for example, ±10° by the damping controller 12.

According to an advantageous embodiment, anti-windup protection is integrated in the damping controller 12, wherein actuator limits of the at least one actuator 11, more particularly a maximum/minimum permissible actuator position $s_{zul}$, a maximum/minimum permissible actuator velocity $v_{zul}$, and a maximum/minimum permissible actuator acceleration $a_{zul}$ of the actuator 11, are specified to the damping controller 12. By means of said integrated anti-windup protection, the damping controller 12 can be adapted to the design of the one or more available actuators 11 of the lifting device 1. To damp the rotational oscillation of the load-handling element 7, the damping controller 12, as described, calculates a manipulated variable of the at least one actuator 11, such as the desired actuator velocity $v_{soll}$. If said desired actuator velocity $v_{soll}$ exceeds a maximum permissible actuator limit, such as the actuator velocity $v_{zul}$, the desired actuator velocity $v_{soll}$ is limited to this maximum permissible actuator velocity $v_{ad}$. Without actuator limits or anti-windup protection, it could happen that, for example, the damping controller 12 calculates an excessively high desired actuator velocity $v_{soll}$, which the at least one actuator 11 could not follow because of the design thereof. This would lead to a control error, and the damping controller 12, in particular the integrator integrated in the damping controller 12, would attempt to compensate said control error in that the manipulated variable, e.g. the desired actuator velocity $v_{soll}$, would be increased further. This "boosting" of the damping controller 12 or in particular of the integrator integrated in the damping controller could lead to destabilization of the damping controller 12, which can be reliably avoided by the integrated anti-windup protection. In addition, a desired actuator acceleration $a_{soll}$ can also be calculated from the desired actuator velocity $v_{soll}$ and can be compared with a maximum/minimum permissible actuator acceleration $a_{zul}$ of the corresponding actuator 11*a*, 11*b*, 11*c*, 11*d*. If said maximum/minimum permissible actuator acceleration $a_{zul}$ is exceeded, this can likewise be taken into account with a limitation of the desired actuator velocity $v_{soll}$. Thus, different embodiments and sizes of actuators 11*a*, 11*b*, 11*c*, 11*d* can be taken into account in the damping controller, whereby the method can be very flexibly applied to a wide range of lifting devices 1.

The invention claimed is:

1. A method for damping rotational oscillation about a vertical axis of a load-handling element of a lifting device via a damping controller having at least one controller parameter, wherein the load-handling element is connected to a suspension element of the lifting device by at least three holding elements, the method comprising:

adjusting a length of at least one holding element between the load-handling element and the suspension element by the damping controller via at least one actuator, acting on the at least one holding element, determining at least one controller parameter by a rotational oscillation model of the load-handling element as a function of a lifting height; and adapting the at least one controller parameter to the lifting height to dampen the rotational oscillation of the load-handling element at any lifting height;

exciting the load-handling element to rotationally oscillate at a certain lifting height of the load-handling element;

sensing, at a same time, at least an actual angle of rotation of the load-handling element about the vertical axis and an actual actuator position; and from the sensed actual angle of rotation and the actual actuator position, identifying model parameters of the rotational oscillation model of the load-handling element at the given lifting height by an identification method.

2. The method according to claim 1, wherein the at least one actuator is hydraulically or electrically actuated.

3. The method according to claim 1, wherein at least four holding elements are provided between the load-handling element and the suspension element.

4. The method according to claim 1, wherein the at least one actuator comprises at least two actuators.

5. The method according to claim 4, wherein the at least one actuator comprises one actuator per holding element.

6. The method according to claim 1, further comprising measuring the lifting height with a camera system arranged on the suspension element or on the load-handling element or by a lifting drive of the lifting device.

7. The method according to claim 1, further comprising measuring the actual angle of rotation of the load-handling element with a measuring device arranged on the suspension element or on the load-handling element.

8. The method according to claim 7, wherein the measuring device comprises a camera system or a gyro sensor.

9. The method according to claim 1, wherein the identification method is a mathematical method.

10. The method according to claim 9, wherein the mathematical method includes an online least-squares method.

11. The method according to claim 1, wherein the damping controller comprises is a state controller.

12. The method according to claim 11, wherein the state controller has five controller parameters.

13. The method according to claim 1, wherein a desired angle of rotation ($\beta_{soll}$) of the load-handling element is specified and the desired angle of rotation ($\beta_{soll}$) of the load-handling element is attained in a specified angle range.

14. The method according to claim 13, wherein the specified angle range is $10° \leq \beta_{soll} \leq +10°$.

15. The method according to claim 1, wherein the lifting device comprises a crane, the holding elements comprise cables and the load-handling element comprises a spreader.

16. A method for damping rotational oscillation about a vertical axis of a load-handling element of a lifting device by a damping controller having at least one controller parameter, wherein the load-handling element is connected to a suspension element of the lifting device by at least three holding elements, the method comprising:

adjusting a length of at least one holding element between the load-handling element and the suspension element by the damping controller via at least one actuator acting on the at least one holding element, determining at least one controller parameter by a rotational oscillation model of the load-handling element as a function of a lifting height; and adapting the at least one controller parameter to the lifting height to dampen the rotational oscillation of the load-handling element at any lifting height, wherein the rotational oscillation model is a second-order differential equation having at least three model parameters.

17. The method according to claim 16, wherein the three model parameters are a dynamic parameter, a damping parameter, and a system gain parameter.

18. A method for damping rotational oscillation about a vertical axis of a load-handling element of a lifting device by a damping controller having at least one controller parameter, wherein the load-handling element is connected to a suspension element of the lifting device by at least three holding elements he, the method comprising:

adjusting a length of at least one holding element between the load-handling element and the suspension element by the damping controller via at least one actuator acting on the at least one holding element, determining at least one controller parameter by a rotational oscillation model of the load-handling element as a function of a lifting height; and adapting the at least one controller parameter to the lifting height to dampen the rotational oscillation of the load-handling element at any lifting height, wherein anti-windup protection is integrated in the damping controller, wherein actuator limits of the at least one actuator are specified to the damping controller.

19. The method according to claim 18, wherein the actuator limits of the at least one actuator is comprise a maximum permissible actuator position, a maximum permissible actuator velocity, and a maximum permissible actuator acceleration of the actuator.

20. A method for damping rotational oscillation about a vertical axis of a load-handling element of a lifting device, wherein the load-handling element is connected to a suspension element of the lifting device by at least three holding elements, the method comprising:

adjusting a length of at least one holding element between the load-handling element and the suspension element via at least one actuator acting on the at least one holding element, determining at least one parameter by a rotational oscillation model of the load-handling element as a function of a lifting height; and adapting the at least one parameter to the lifting height to dampen the rotational oscillation of the load-handling element at any lifting height;

exciting the load-handling element to rotationally oscillate at a certain lifting height of the load-handling element;

sensing, at a same time, at least an actual angle of rotation of the load-handling element about the vertical axis and an actual actuator position; and from the sensed actual angle of rotation and the actual actuator position, identifying model parameters of the rotational oscillation model of the load-handling element at the given lifting height by an identification method.

* * * * *